US005394173A

United States Patent [19]

Kubota

[11] Patent Number: 5,394,173

[45] Date of Patent: Feb. 28, 1995

[54] CIRCUIT SUBSTRATE-MOUNTED SCANNING OPTICAL SYSTEM

[75] Inventor: Takeshi Kubota, Yokohama, Japan

[73] Assignee: Canon Kabushiki Kaisha, Tokyo, Japan

[21] Appl. No.: 29,947

[22] Filed: Mar. 9, 1993

Related U.S. Application Data

[63] Continuation of Ser. No. 645,455, Jan. 24, 1991, abandoned.

[30] Foreign Application Priority Data

Jan. 31, 1990 [JP] Japan ..... 2-21429

[51] Int. Cl.[6] ..... B41J 27/435

[52] U.S. Cl. ..... 347/257

[58] Field of Search ..... 346/107 R, 76 L, 139 R, 346/1.1, 108, 160

[56] References Cited

U.S. PATENT DOCUMENTS 4,232,954 11/1980 Kitamura et al. ..... 354/7
4,707,709 11/1987 Tsilibes ..... 346/108
4,750,163 6/1988 Yamamiya et al. ..... 369/54
4,800,401 1/1989 Sato et al. ..... 346/108
4,805,175 2/1989 Knowles ..... 372/24
4,915,465 4/1990 Sugiura ..... 350/6.5
4,977,412 12/1991 Komori et al. ..... 346/108
5,012,464 4/1991 Vedder et al. ..... 369/116

FOREIGN PATENT DOCUMENTS 3040539 5/1982 Germany .
3807659 9/1989 Germany .

*Primary Examiner*—Mark J. Reinhart
*Attorney, Agent, or Firm*—Fitzpatrick, Cella, Harper & Scinto

[57] ABSTRACT

A scanning optical system comprises a motor driver circuit card for scanning and focusing a light beam emitted from a light source such as a laser oscillator to an object to be scanned such as a photoconductor drum through a deflector such as a polygon mirror and a focusing lens and driving a motor which drives the deflector, and the lens is mounted on the motor driver circuit card.

90 Claims, 11 Drawing Sheets

CIRCUIT SUBSTRATE-MOUNTED SCANNING OPTICAL SYSTEM

This application is a continuation of application Ser. No. 07/645,455, filed Jan. 24, 1991, now abandoned.

BACKGROUND OF THE INVENTION

1. Field of the Invention

The present invention relates to a scanning optical system such as a printer which forms an image by an electrophotographic process.

2. Related Background Art

FIG. 1 shows an overall configuration of a prior art laser beam printer which is an image recorder by an electrophotographic process. Numeral 100 denotes a printer body, numeral 102 denotes a cassette for accommodating transfer sheets S, numeral 104 denotes a feed roller for taking the transfer sheets S one by one from the cassette 102, numeral 105 denotes a separation pad for separating each of the sheets S, numeral 106 denotes a regist roller for controlling a feed timing of the transfer sheets S, numeral 108 denotes a transfer charger, and numeral 110 denotes a process cartridge which contains therein a photoconductor drum 112, a developing unit (not shown), a charger (not shown), and a cleaning unit (not shown) for the drum 112. Numeral 114 denotes a fixing unit, numeral 116 denotes a fixing roller made of an aluminum pipe, numeral 117 denotes a halogen heater, and numeral 118 denotes a rubber pressure roller. Developing agent on the transfer sheet S is solved and fixed by heat and pressure applied-by the fixing roller 116 and the pressure roller 118. Numeral 120 denotes a convey roller, numeral 122 denotes an ejection roller, numerals 124*a* and 124*b* denote decurling rolls and numeral 126 denotes an ejection tray.

A laser scanner unit 101 for scanning a laser beam L is provided in the printer body 100. The laser beam L is reflected by a mirror 103 and directed to the photoconductor drum 112.

When a print signal is applied to the printer from a host computer (not shown), the transfer sheet S is taken out of the cassette 102 by the feed roller 104 and fed by the regist roller in a timed fashion with a developing image on the photoconductor drum 112. An image written on the drum 112 by the laser beam L is transferred to the transfer sheet S. Then, the transferred image is fixed by the fixing unit 114 and the transfer sheet S is fed and ejected by the convey roller 120 and the ejection roller 122, and stacked on the ejection tray 126.

FIG. 2 shows a plan view of a laser optical system in the laser scanner unit 101. A light beam emitted from a laser oscillator 107 is reflected by a mirror surface of a polygon mirror 111 supported by a polygon rotor 109 which is rotated at a constant velocity in a direction a so that it is scanned in a main scan direction (arrow b). The light beam thus scanned passes through a focusing lens 113, is reflected by a reflection mirror 103 and directed to and focused on the drum 112. Since the drum 112 is rotated in a sub-scan direction (which is perpendicular to the main scan direction and an optical axis of the optical system) by a predetermined amount for each scan, a two-dimensional image is formed on the drum 112 by the scanned light beam L.

On the other hand, the scanned light beam at the start of the scan is reflected by a reflection mirror 115 in each scan, and the reflected light is directed to a DC controller by an optical fiber 119 as a horizontal synchronous signal (which is a signal for determining a start position of recording in order to maintain a constant start position of scanning on the drum, and which is hereinafter referred to as BD). The rotation of the polygon mirror is controlled by a motor driver circuit card 123 which is accommodated in a housing 125.

The above prior art system includes the following shortcoming.

As shown in FIG. 2, the focusing lens 113 and the scanner motor including the polygon mirror 111 are mounted on the housing 125 of the laser scanning optical system. Accordingly, the housing 125 of a precise and complex shape to accommodate those parts is required. This increases cost.

Further, since the BD circuit in the DC controller 121 is located externally of the housing 125 of the laser scanning optical system, connection means such as optical fiber 119 is required.

SUMMARY OF THE INVENTION

It is an object of the present invention to provide a compact, inexpensive and precise scanning optical system in which a motor driver circuit card has a framing function.

In order to achieve the above object, in accordance with the present invention, a scanning optical system comprises a motor driver circuit card for scanning and focusing a light beam emitted from a light source such as a laser oscillator to an object to be scanned such as a photoconductor drum through a deflector such as a polygon mirror and a focusing lens and driving a motor which drives the deflector, and the lens is mounted on the motor driver circuit card.

DETAILED DESCRIPTION OF THE PREFERRED EMBODIMENTS

Figure 3:
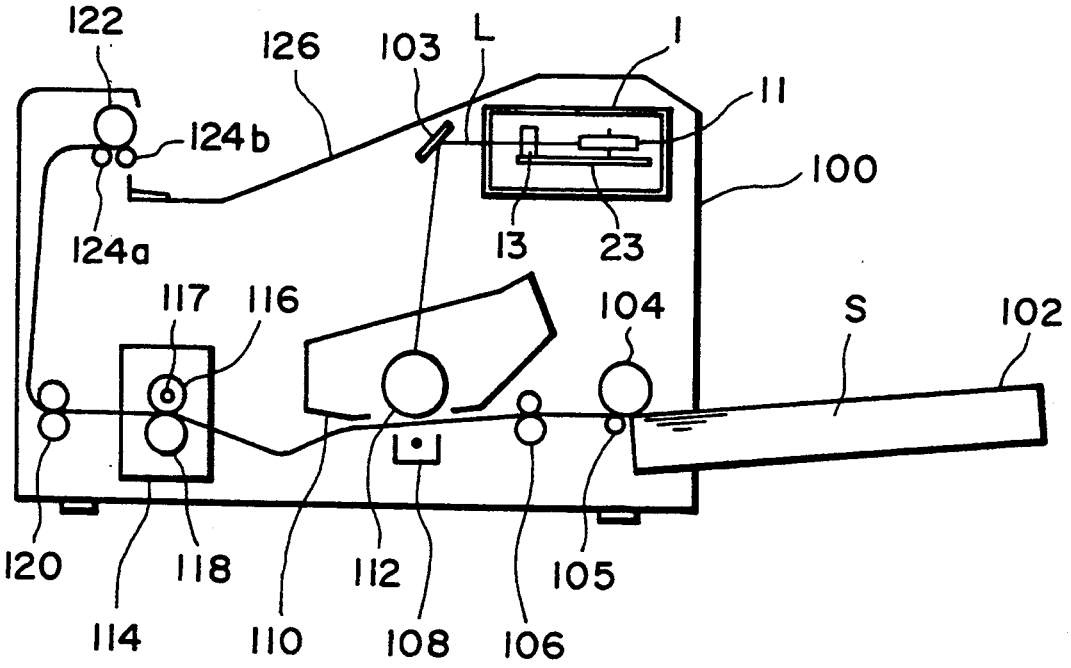
FIG. 3 shows a sectional view of a laser beam printer which incorporates an embodiment of a scanning optical system of the present invention.

The embodiments of the scanning optical system of the present invention are now explained. FIG. 3 shows a printer which is identical to the printer shown in FIG. 1 except the laser scanner unit 1, and FIG. 4 shows a plan view of a first embodiment of the laser optical system in the laser scanner unit 1.

Figure 4:
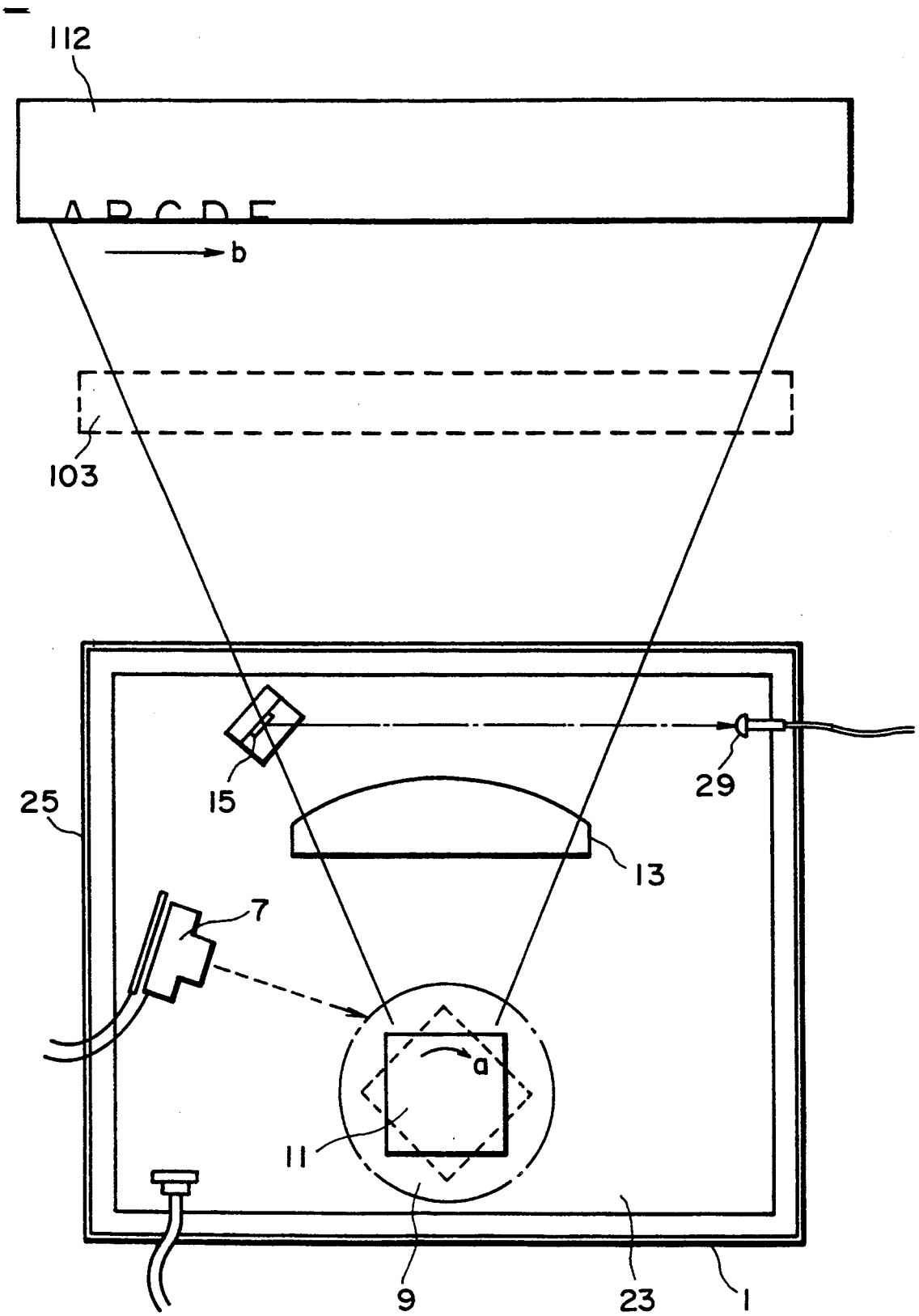
FIG. 4 shows a plan view of a first embodiment of the present invention.

In FIG. 4 which shows the first embodiment, a laser oscillator 7 which functions as a light source, a focusing lens having an f-$\theta$ characteristic, a reflection mirror or BD mirror 15 and a BD photo-sensor 29 which detect a synchronous signal for determining a start timing of modulation of the light source, are mounted on a motor driver circuit card for driving a motor which drives a polygon mirror 11.

Since the light source is mounted on the motor driver circuit card and the BD mirror which receives the writing scanning light beam and deflects a light path of the light beam for detecting a horizontal synchronous light signal is also mounted on the motor driver circuit card, the positioning of the components to the circuit board is easily and precisely carried out. Means (circuit) for supplying a drive signal to drive the motor and controlling the drive signal is mounted on the motor driver circuit card 23.

Those components may be mounted in the following manner.

Figure 5:
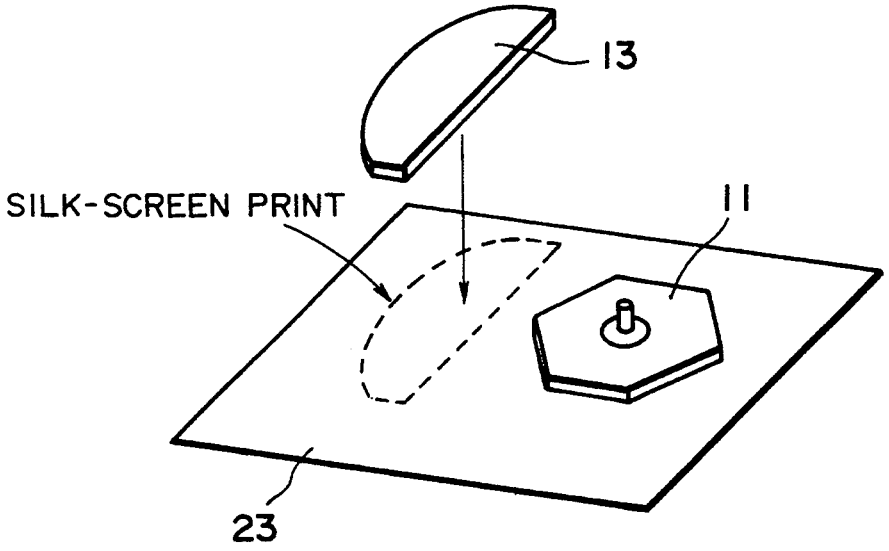
FIGS. 5 to 9 show methods of mounting components on a motor driver circuit board.

FIG. 5 shows a method of mounting the focusing lens 13 at a predetermined area in the motor driver circuit card 23 by direct bonding. A position of the focusing lens on the motor driver circuit card 23 is marked by silk screen print so that electrical components are not mounted thereon. The focusing lens 13 is fixed to the marked position by bonding material. Parts of a height which interferes the light path are not mounted in the light path of the scanning light beam.

Other components may also mounted on the motor driver circuit card by direct bonding.

Figure 6:
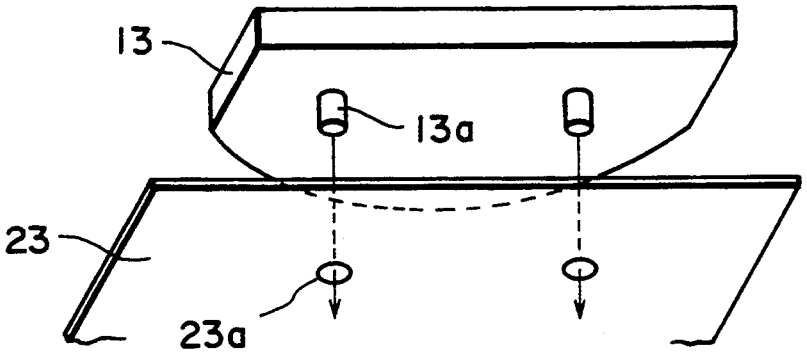

FIG. 6 shows a method of mounting the focusing lens 13 on the motor driver circuit card 23 by thrusting. A hole 23*a* is formed in the motor driver circuit card 23 at a position corresponding to the mount position of the focusing lens 13, and a boss 13*a* of the focusing lens 13 is inserted into the hole 23*a* to mount the focusing lens 13 on the motor driver circuit card 23. In this method, the positioning of the components to the motor driver substrate 23 is facilitated.

Figure 7:
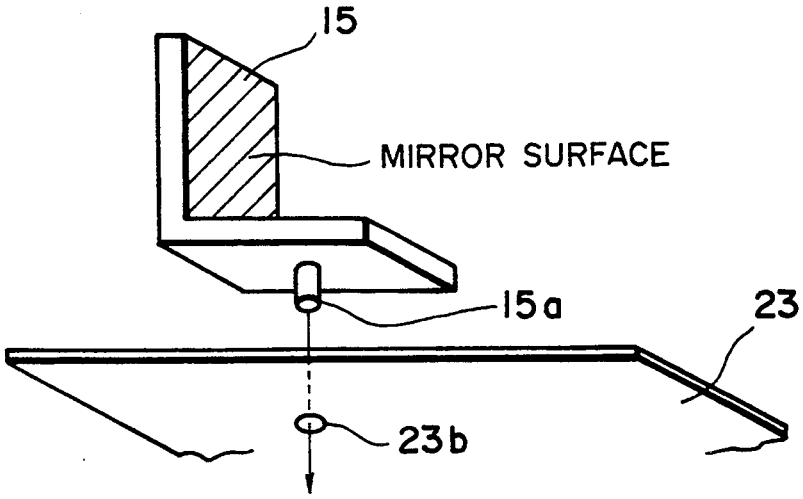

Other components may also be mounted in this method. FIG. 7 shows a method of mounting the BD mirror which directs the light beam deflected by the deflector to a predetermined direction, in this method. The BD mirror 15 is integrally formed by a plastic mold member or an L-shaped base on which a reflection mirror surface is formed by mirror coating. A positioning pin 15*a* which functions as a fixing member is inserted into a hole 23*b* formed at a predetermined position on the motor driver circuit card to position and fix the components. The positioning pin 15*a* extends parallelly to the mirror surface and coincides with a center of rotation of the mirror surface to facilitate the adjustment of the direction of reflection of the scanning light beam along the scan direction.

Figure 8:
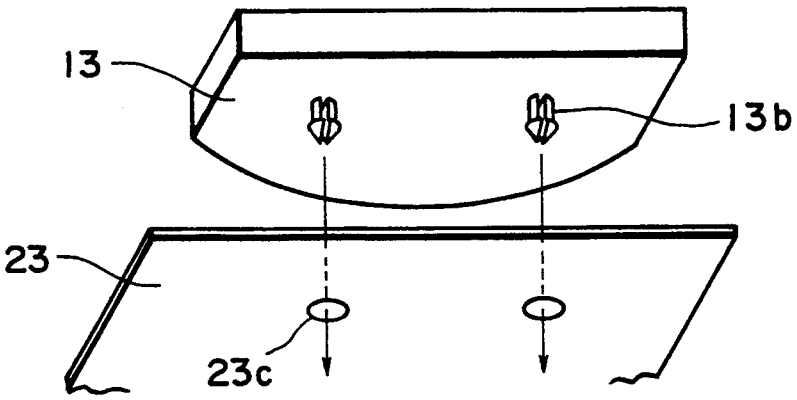

The components may be mounted in a manner shown in FIG. 8. In FIG. 8, a boss 13*b* of the focusing lens 13 is fixed to a hole 23*c* of the motor driver circuit card 23 in a patchin manner. An end of the pin 13*b* of the focusing lens 13 made of plastic mold is split and has a locking portion at a tip end. Thus, when the pin 13*b* is inserted into the hole 23*c*, the pin 13*b* is locked by the hole 23*c*, and the assembly is fixed without bonding material.

Figure 9:
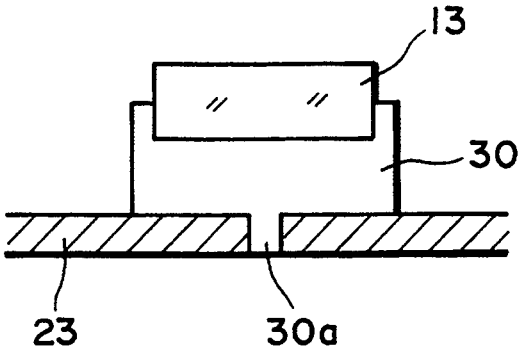

As shown in FIG. 9, the focusing lens 13 may be mounted on the motor driver circuit card 23 through a lens mount 30. The focusing lens 13 is previously bonded to the lens mount 30, and a pin 30*a* of the mount 30 is inserted into a hole of the motor driver circuit card 23 to fix it. In this arrangement, the thickness of the lens 13 may be minimum without regard to the height of the light path and an inexpensive scanning optical system is attained.

In this manner, the focusing lens 13, the laser oscillator 7, the BD mirror 15 and the BD photosensor 29 are readily and precisely positioned and fixed to the motor driver circuit card 23 with the framing function. Thus, the assembly cost of the components is reduced.

Figure 10:
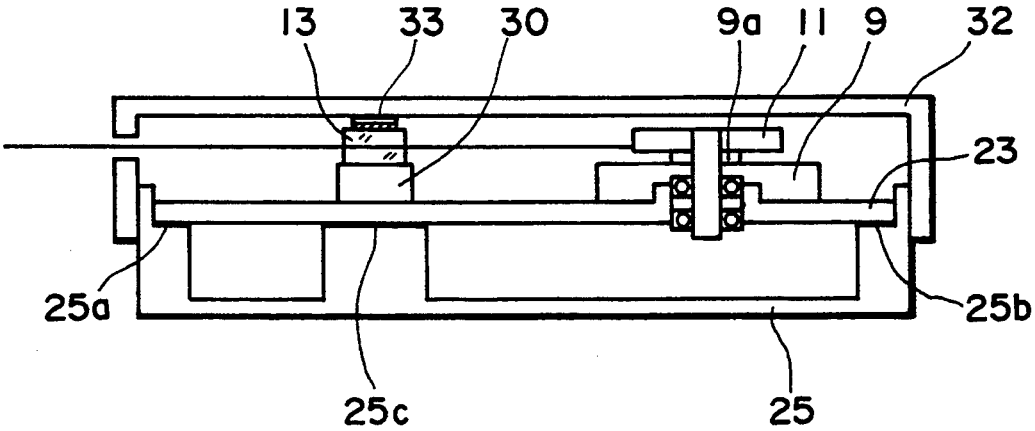
FIG. 10 shows a sectional view of the motor driver circuit card accommodated in a housing of the scanning optical system.

While not described in the above fixing method, the laser oscillator 7 is directly fixed to the motor driver circuit card 23. As shown in FIG. 10, the polygon mirror 11 is fixed to a rotor 9 which is a portion of a polygon motor. The rotor 9 comprises a magnet (not shown) and a polygon fixing plate 9*a* and it is mounted to face a stator coil (not shown) arranged on the motor driver circuit card 23. (See FIG. 12B which will be explained later.)

FIG. 10 shows the motor driver circuit card 23 attached to a housing 25 of the scanning optical system. The motor driver circuit card 23 is at four points, that is, fixing bases 25*a* and 25*b* on the housing 25 and two other points (not shown). Further, a base 25*c* for supporting the motor driver circuit card 23 is provided in a vicinity of the focusing lens 13 to prevent the deformation and vibration of the motor driver circuit card 23. In FIG. 10, the focusing lens 13 is fixed in the manner shown in FIG. 9.

The housing 25 is dust-proof sealed by a cover 32 and an elastic member 33 is arranged at a position on an inner side of the cover 32 facing the focusing lens 13. Thus, when the cover 32 is fixed to the housing 25, the focusing lens 13 is pressed by the base 25*c* of the scanning optical system housing 25 so that it is positively fixed.

The material of the motor driver circuit card 23 may be glass or epoxy, and metal card (iron card or aluminum card) is more advantageous in terms of rigidity.

Figure 1:
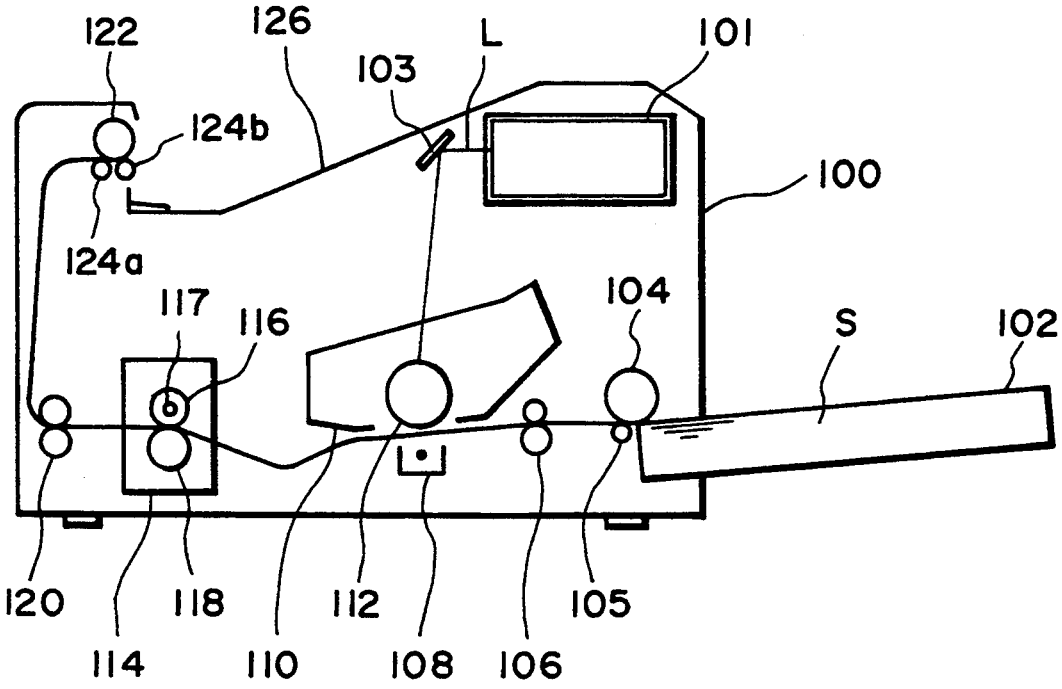
FIG. 1 shows a sectional view of a prior art printer.
Figure 2:
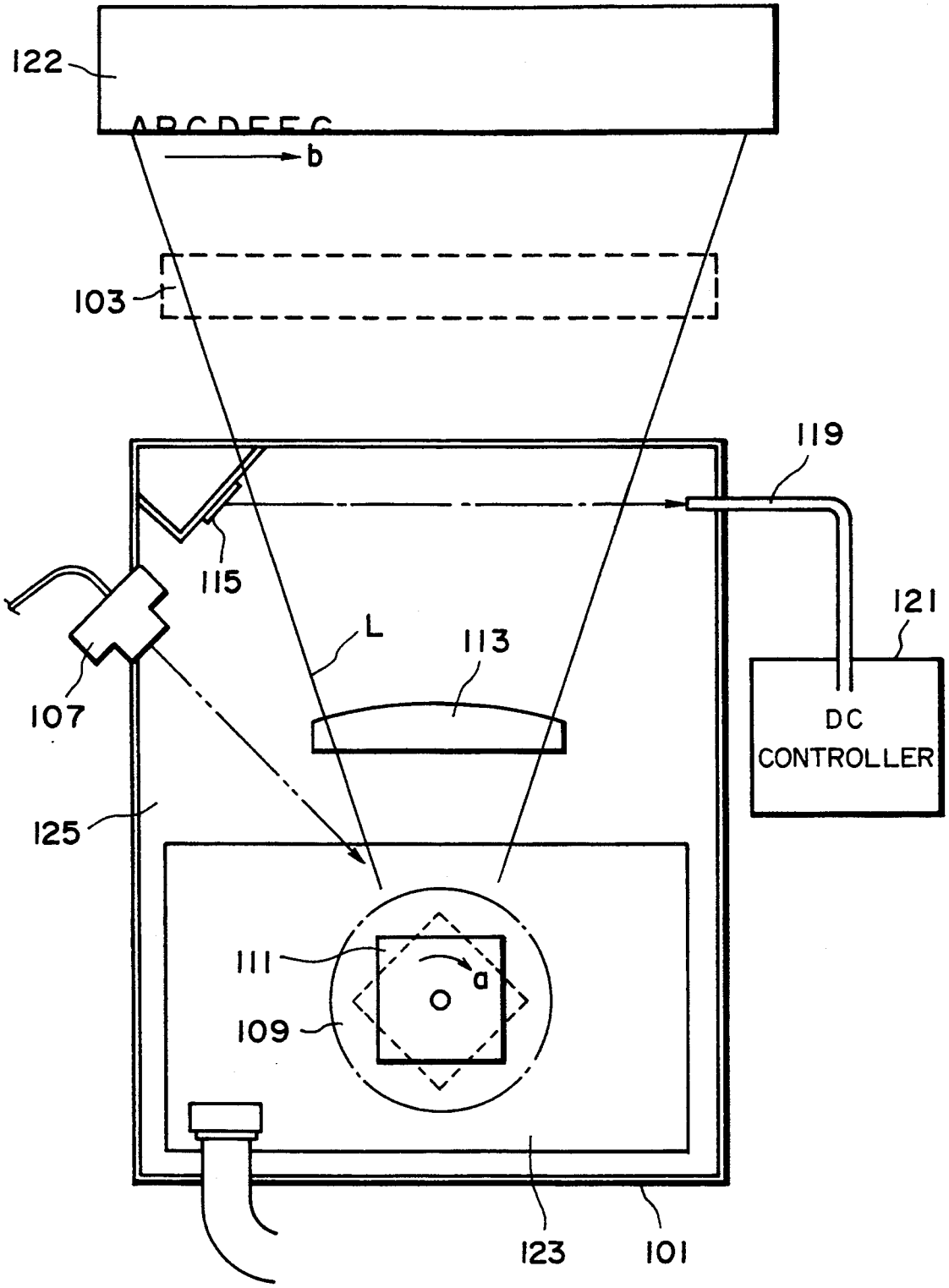
FIG. 2 shows a scanning optical system of the prior art printer.

The operation of the present embodiment is substantially same as that explained in FIGS. 1 and 2.

Figure 11:
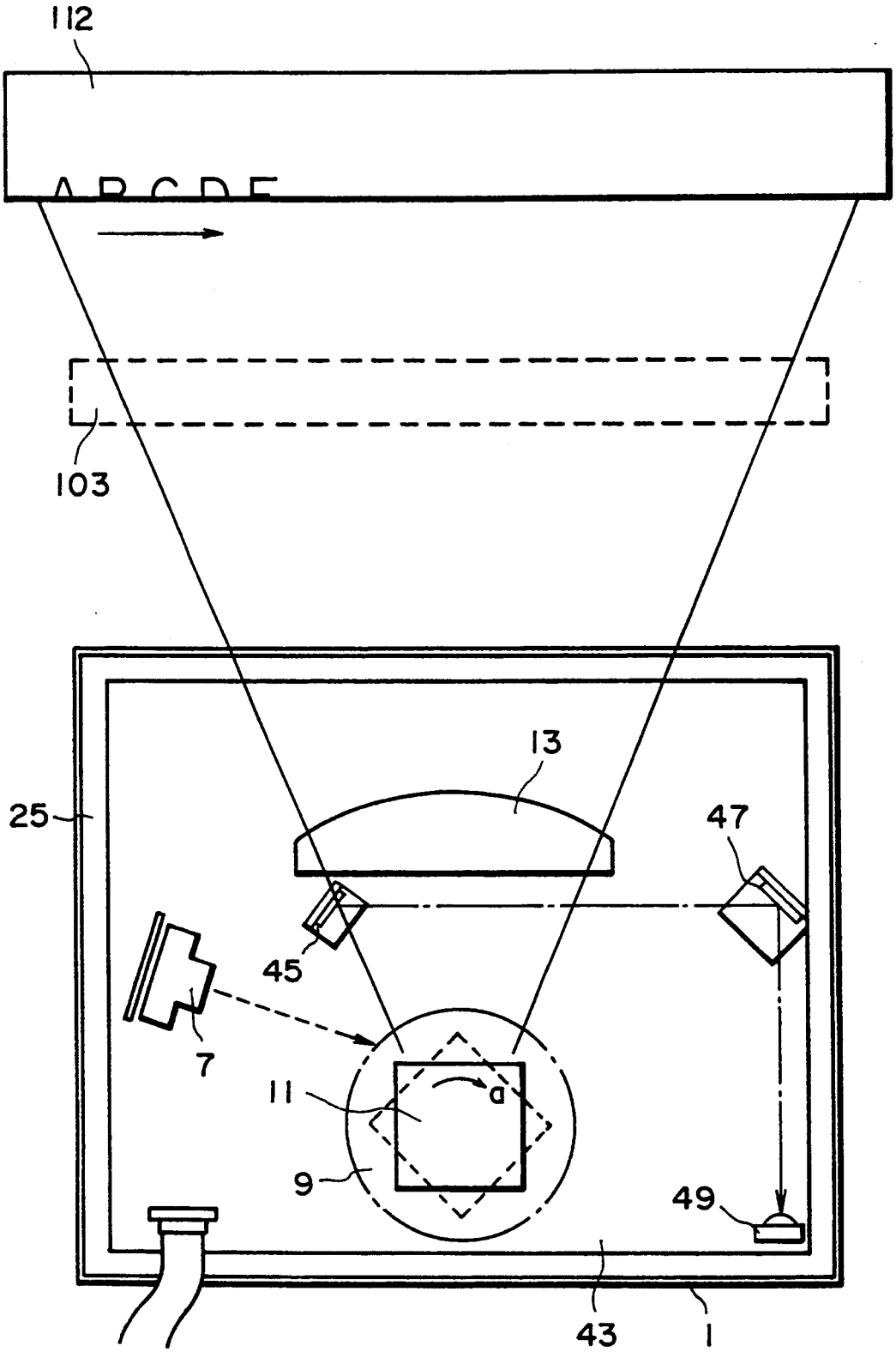
FIG. 11 shows a plan view of a second embodiment of the scanning optical system of the present invention.

FIG. 11 shows a second embodiment of the scanning optical system of the present invention. The like shape or function components to those in the first embodiment are designated by the like numerals and the explanation thereof is omitted.

In the second embodiment, a BD circuit (horizontal synchronous signal detection circuit) including a BD photosensor 49 is mounted on a motor driver circuit card 43 in the scanning optical system. The scanning light beam from the polygon mirror 11 is reflected by two reflection mirrors 45 and 47 mounted on the motor driver circuit card 43 and directed to the BD photosensor 49.

By this arrangement, the BD signal can be directly sensed on the motor driver circuit card 43 so that connection means such as an optical fiber is saved and the cost is reduced. In addition, a loss of light is also suppressed.

Other construction is same as that of the first embodiment.

Figure 12A:
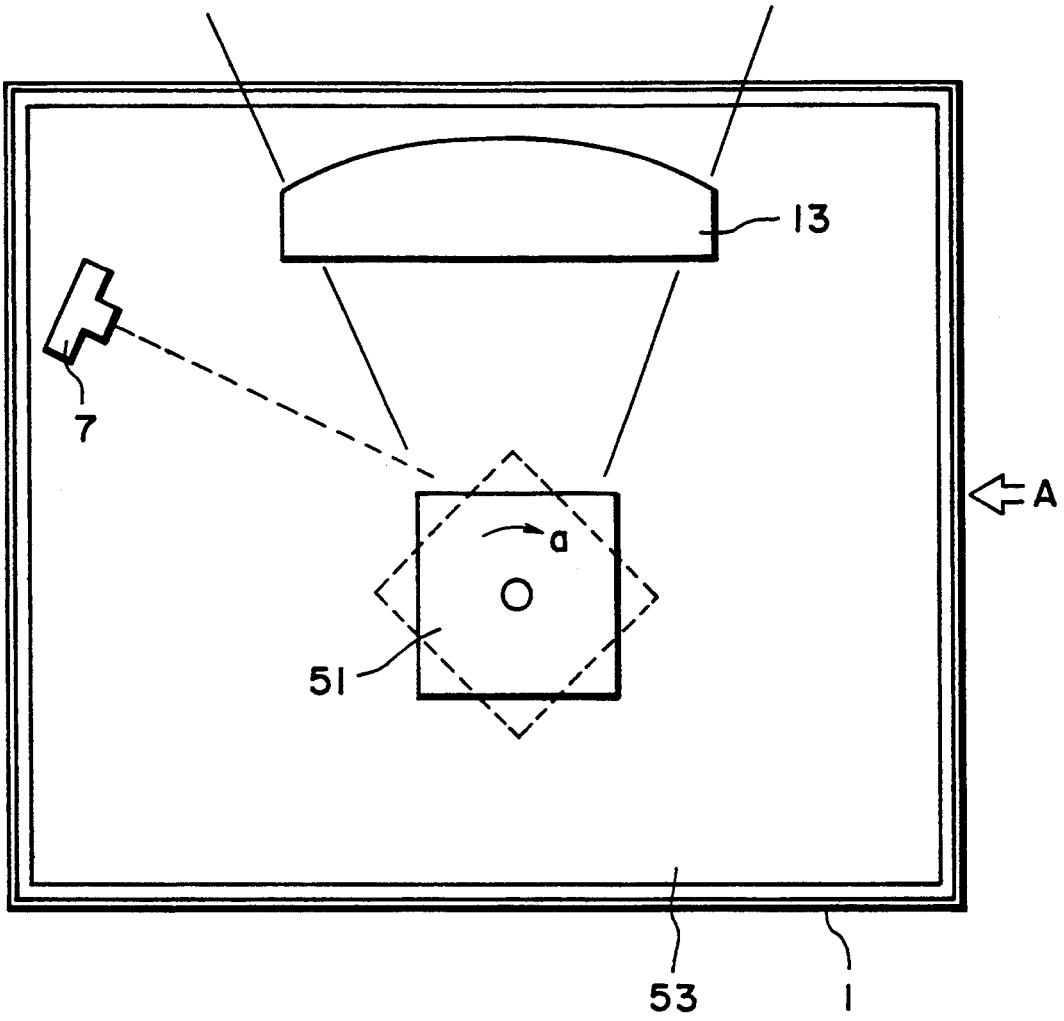
FIG. 12A shows a plan view of a third embodiment.
Figure 12B:
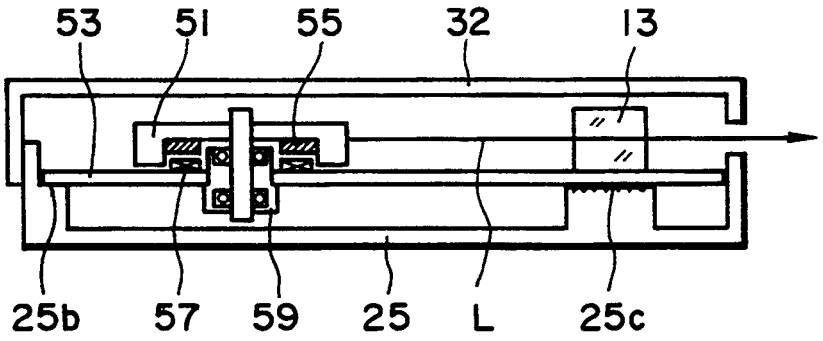
FIG. 12B shows a sectional view taken along arrows shown in FIG. 12A.

A third embodiment is now explained with reference to FIGS. 12A and 12B.

In the third embodiment, the laser oscillator 7, the focusing lens 13 and a polygon mirror 51 are mounted on a motor driver circuit card 53, and the polygon mirror 51 is rendered hollow and a rotor magnet 55 of a scanner motor is mounted in the internal space of the polygon mirror 51 so that the polygon mirror 51 and the rotor are integral. Numeral 57 denotes a stator coil mounted on the motor driver circuit card 53, and numeral 59 denotes a bearing for the polygon mirror 51. The bearing 59 is also mounted on the motor driver circuit card.

By integrating the polygon mirror 51 and the rotor, the height of the scanning light beam L as measured from the motor driver circuit card 53 is suppressed low. As a result, the thickness of the lens 13 can be reduced and the lens mount is not necessary. Thus, the overall structure of the laser scanner unit is thin and the space saving is easily attained, and the entire system can also be thinned.

Since the scanning light beam is usually scanned at a relatively high position measured from the level of the motor driver circuit card 53, it is necessary to thicken the lens or provide the mount as shown in FIG. 9. In the arrangement shown in FIGS. 12A and 12B, however, the lens 13 is thin and directly mounted on the motor driver circuit card 53 with high precision. Since no large lens is required nor the lens mount is necessary, the cost is reduced. When the mount position of the lens 13 is high as measured from the motor driver circuit card 53, the lens 13 is subject to vibration, but since it is at a low position, the effect of vibration is eliminated.

Figure 13:
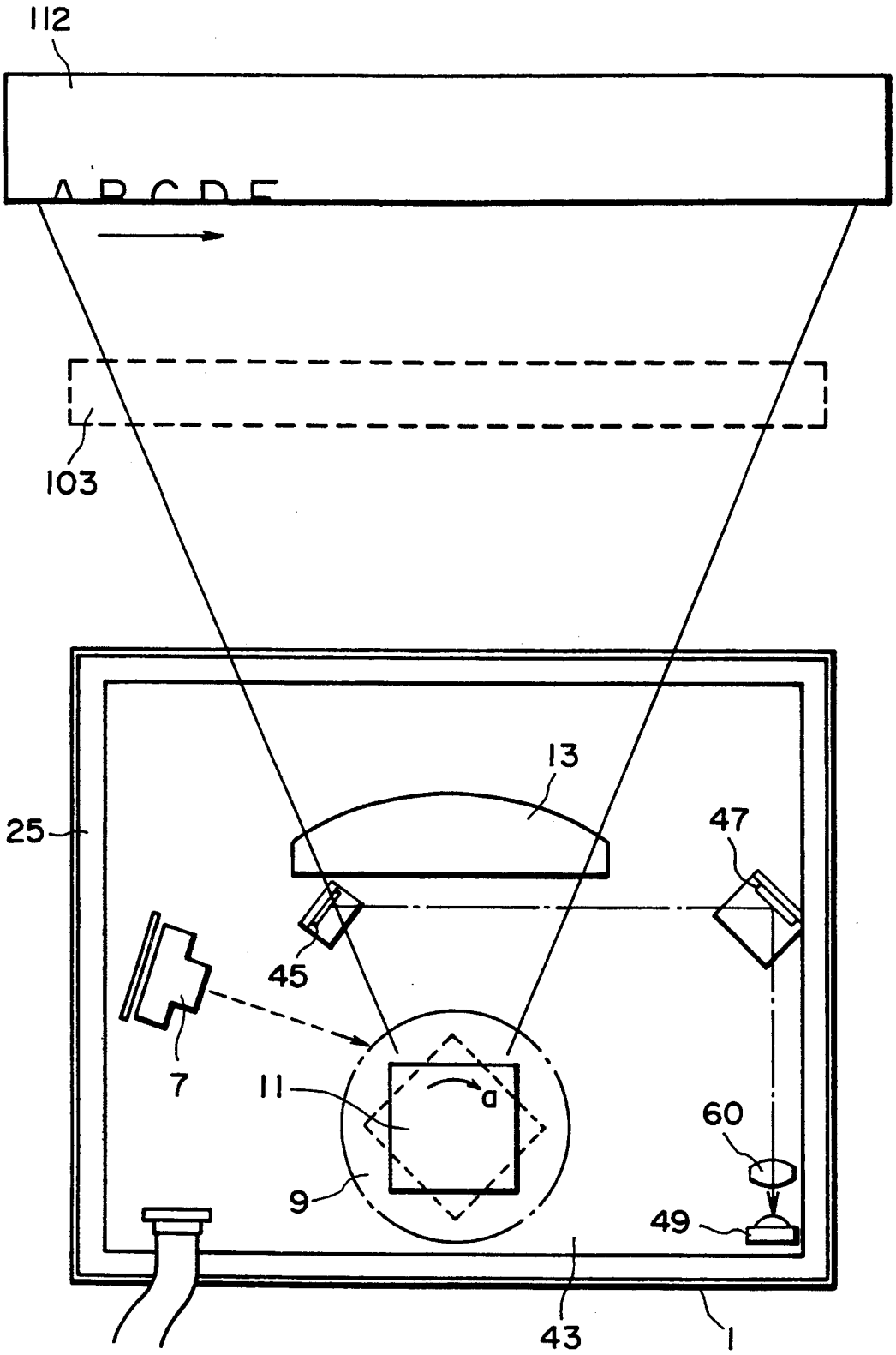
FIG. 13 shows a fourth embodiment of the scanning optical system of the present invention.

A fourth embodiment of the scanning optical system of the present invention is now explained with reference to FIG. 13. The like shape or function components as those in the second embodiment are designated by the like numerals and the explanation thereof is omitted.

In the fourth embodiment, a BD lens 60 is mounted on a motor driver circuit board 43 in the scanning optical system. A scanning light beam from the polygon mirror 11 is reflected by two reflection mirrors 45 and 47, focused by the BD lens 60 and directed to a BD photosensor 49.

By this arrangement, a stable BD signal is produced even if vibration is included.

Figure 14:
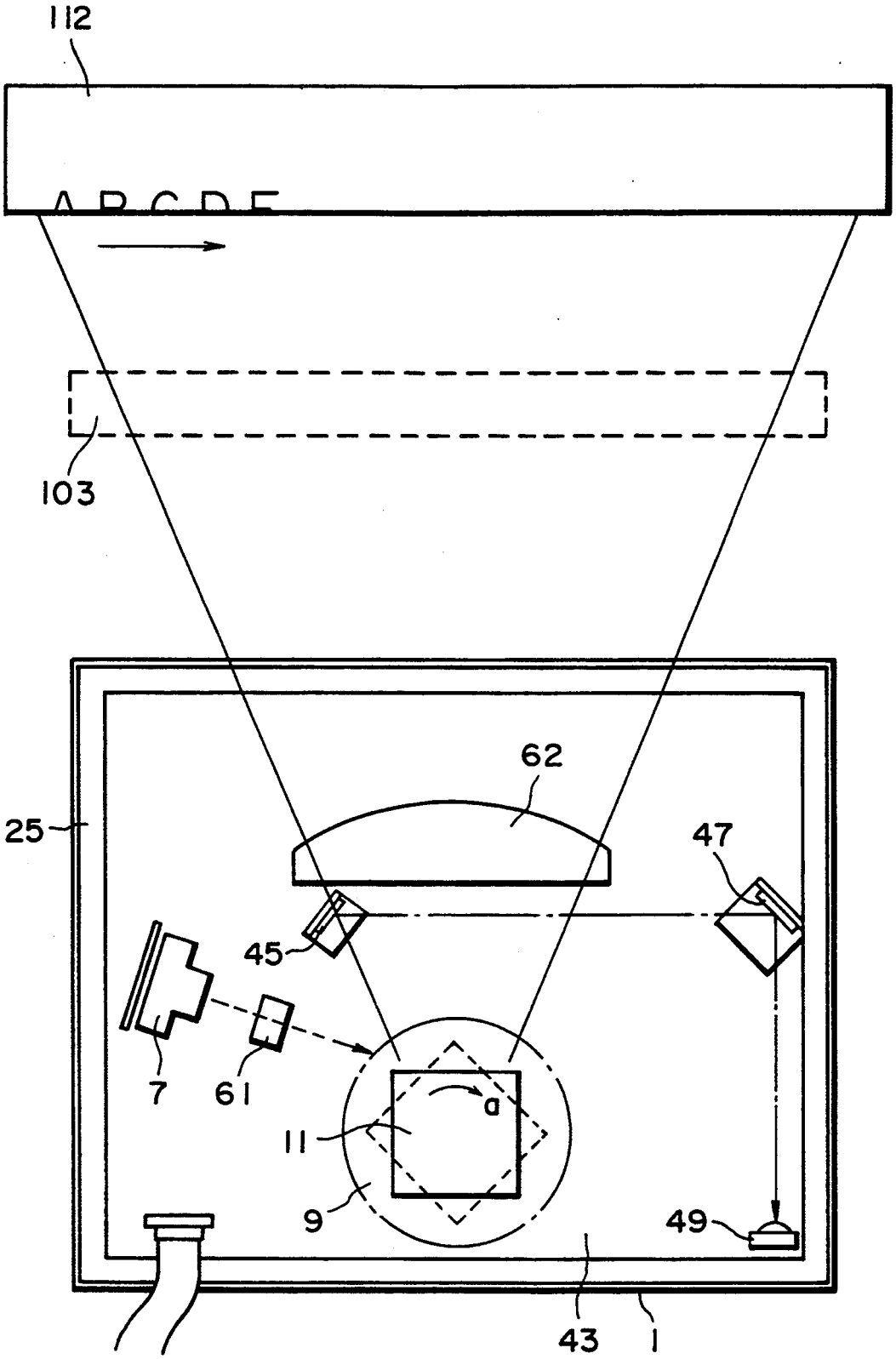
FIG. 14 shows a fifth embodiment of the scanning optical system of the present invention.

A fifth embodiment of the scanning optical system of the present invention is now explained with reference to FIG. 14. The like shape or function components as those in the second embodiment are designated by the like numerals and the explanation thereof is omitted.

In the fifth embodiment, a cylindrical lens 61 and a toric lens 62 are mounted on the motor driver circuit card 43 of the scanning optical system. A light beam from the laser oscillator 7 is linearly focused on a deflecting reflection plane of the polygon mirror 11 by the cylindrical lens 61, and the light beam deflected by the polygon mirror 11 is focused on a drum 112 by the toric lens 62.

With this arrangement, even if the travel direction of the deflected light beam changes to a sub-scan direction by a skew of the deflecting scan plane of the polygon mirror, the pitch of the scan line on the scanned plane is uniform.

As described hereinafter, the present invention relates to a scanning optical system which comprises a motor driver circuit card for scanning and focusing a light beam emitted from a light source to an object to be scanned through a deflector and a focusing lens and driving a motor which drives the deflector. The lens is mounted on the motor driver circuit card.

The light source may be mounted on the motor driver circuit card. The BD mirror which receives a portion of the writing scanning light beam and changes the light path of the light beam to detect the BD light may be mounted on the motor driver circuit card.

The motor driver circuit card may include the BD detection circuit.

Where the deflector is a polygon mirror, the rotor magnet may be mounted in the internal space of the polygon mirror, and the stator coil and the bearing for the polygon mirror which rotatably supports the rotation shaft of the polygon mirror may be mounted on the motor driver circuit card in order to reduce the height of the mirror surface of the polygon mirror measured from the motor driver circuit board.

In the embodiments of the present invention described above, the polygon mirror which provides a constant angular velocity to the swing of the light beam is used as the deflector. Alternatively, a galvanomirror which provides non-constant angular velocity to the swing of the light beam may be used as the deflector.

In the above embodiments, means for supplying the drive signal to drive the motor and controlling the drive signal are mounted on the motor driver circuit card. Alternatively, the lens may be mounted on a first circuit card on which the coil and the magnet of the motor are mounted and the means for supplying the drive signal to drive the motor and controlling the drive signal may be mounted on a second circuit card different from the first circuit card.

In the above embodiments, the lens is mounted on the motor driver circuit card by bonding or patchin. Alternatively, it may be fixed by bolts or press-fixed by an elastic member such as a spring.

In accordance with the present invention, since the components required for the light beam scan are mounted on the motor driver circuit card of the scanning optical system, a high precision and complex optical housing required in the prior art optical system is not necessary and the circuit card can have the framing function.

By mounting the BD circuit on the circuit card, the motor driver circuit card can have a high value added function and the optical fiber is no longer necessary and light loss is reduced.

In this manner, compact, inexpensive and high precision scanning optical system is provided.

I claim:

1. A scanning optical system comprising:

a light source;

a deflector for deflecting a light beam emitted from said light source;

a circuit substrate including drive means for rotating said deflector; and optical means for focusing the light beam deflected by said deflector to a predetermined plane and mounted directly on the circuit substrate of said drive means.

2. A scanning optical system according to claim 1 wherein said light source is mounted on the circuit substrate of said drive means.

3. A scanning optical system according to claim 1 wherein the circuit substrate of said drive means is a metal circuit substrate.

4. A scanning optical system comprising:

a light source;

a deflector for deflecting a light beam emitted from said light source;

a circuit substrate including drive means for rotating said deflector; and photosensing means for sensing the light beam deflected by said deflector and mounted directly on the circuit substrate of said drive means.

5. A scanning optical system according to claim 4 wherein said photosensing means detects a synchronous signal for determining a start timing of the modulation of said light source.

6. A scanning optical system comprising:
a light source;
a deflector for deflecting a light beam emitted from said light source;
a circuit substrate including drive means for rotating said deflector;
optical means for directing the light beam deflected by said deflector to a predetermined direction and mounted directly on the circuit substrate of said drive means; and
photosensing means for sensing the light beam directed to the predetermined direction by said optical means.

7. An image recorder comprising:
a light source;
a deflector for deflecting a light beam emitted from said light source;
a circuit substrate including drive means for rotating said deflector;
optical means for focusing the light beam deflected by said deflector and mounted directly on the circuit substrate of said drive means; and
a photoconductor for receiving the light beam focused by said optical means.

8. A light deflector comprising:
a deflector;
a circuit substrate including drive means for rotating said deflector; and
lens means mounted on the circuit substrate of said drive means.

9. A light deflector according to claim 8 wherein the circuit substrate of said drive means is a metal circuit substrate.

10. A scanning optical system according to claim 3, wherein the metal circuit substrate is an iron substrate.

11. A scanning optical system according to claim 1, wherein said optical means comprises an f-$\theta$ lens.

12. A scanning optical system according to claim 1, wherein said optical means is adhesively mounted on the circuit substrate.

13. A scanning optical system according to claim 1, wherein a positioning member for said optical means is provided on the circuit substrate.

14. A scanning optical system according to claim 1, wherein the circuit substrate supports a bearing of said deflector.

15. A scanning optical system according to claim 4, wherein the circuit substrate of said drive means is a metal substrate.

16. A scanning optical system according to claim 15, wherein said metal circuit substrate is an iron substrate.

17. A scanning optical system according to claim 4, wherein the circuit substrate supports a bearing of said deflector.

18. A scanning optical system according to claim 4, further comprising a circuit for said photosensing means, the circuit being provided on the circuit substrate.

19. A scanning optical system according to claim 4, wherein reflecting means is provided in an optical path between said deflector and said photosensing means.

20. A scanning optical system according to claim 19, wherein said reflecting means is provided on the circuit substrate.

21. A scanning optical system according to claim 4, wherein lens means is provided in an optical path from said deflector.

22. A scanning optical system according to claim 21, wherein said lens means is provided on the circuit substrate.

23. A scanning optical system according to claim 6, wherein said photosensing means detects a synchronous signal for determining a timing of modulation start of said light source.

24. A scanning optical system according to claim 23, wherein said photosensing means is mounted on the circuit substrate.

25. An image recorder according to claim 7, wherein the circuit substrate of said drive means is a metal substrate.

26. An image recorder according to claim 25, wherein the metal circuit substrate is an iron substrate.

27. An image recorder according to claim 7, wherein said optical means comprises an f-$\theta$ lens.

28. An image recorder according to claim 7, wherein said optical means is adhesively mounted on the circuit substrate.

29. An image recorder according to claim 7, wherein a positioning member for said optical means is provided on the circuit substrate.

30. An image recorder according to claim 7, wherein the circuit substrate supports a bearing of said deflector.

31. A light deflector according to claim 9, wherein the metal circuit substrate is an iron substrate.

32. A light deflector according to claim 8, wherein the circuit substrate supports a bearing of said deflector.

33. A scanning optical system, comprising:
a light source;
a deflector for deflecting a light beam from said light source;
a substrate including drive means for rotating said deflector;
optical means for guiding the light beam deflected by said deflector in a predetermined direction; and
photosensing means for receiving the light beam guided by said optical means in the predetermined direction, said photosensing means being mounted directly on the substrate of said drive means.

34. An image recorder, comprising:
a light source;
a deflector for deflecting a light beam from said light source;
a substrate including drive means for rotating said deflector;
photosensing means for receiving the light beam deflected by said deflector, said photosensing means being mounted directly on the substrate of said drive means; and
a photoconductor for receiving the light beam deflected by said deflector.

35. An image recorder according to claim 34, wherein the substrate of said drive means is a metal substrate.

36. An image recorder according to claim 35, wherein the metal substrate is an iron substrate.

37. An image recorder according to claim 34, wherein said substrate supports a bearing of said deflector.

38. An image recorder according to claim 34, wherein a circuit of said photosensing means is also provided on the substrate.

39. An image recorder according to claim 34, wherein reflecting means is provided in an optical path between said deflector and said photosensing means.

40. An image recorder according to claim 39, wherein said reflecting means is provided on the substrate.

41. An image recorder according to claim 39, wherein lens means is provided in an optical path between said deflector and said photosensing means.

42. An image recorder according to claim 41, wherein said lens means is provided on the substrate.

43. An image recorder according to claim 34, wherein said photosensing means detects a synchronous signal for determining a timing of modulation start of said light source.

44. An image recorder, comprising:
a light source;
a deflector for deflecting a light beam from said light source;
a substrate including drive means for rotating said deflector;
photosensing means for receiving the light beam deflected by said deflector, said photosensing means being mounted directly on the substrate of said drive means;
optical means for focusing the light beam deflected by said deflector to a predetermined plane; and
a photoconductor for receiving the light beam focused by said optical means.

45. A scanning optical apparatus comprising:
a deflector;
a circuit substrate including drive means for rotating said deflector; and
a light source for emitting a light beam to be deflected by said deflector, said light source being mounted directly on said circuit substrate.

46. A scanning optical apparatus according to claim 45, wherein said circuit substrate is a metal substrate.

47. A scanning optical apparatus according to claim 46, wherein said metal substrate is an iron substrate.

48. A scanning optical apparatus according to claim 45, wherein said circuit substrate supports a bearing of said deflector.

49. An image recorder comprising:
a deflector;
a circuit substrate including drive means for rotating said deflector;
a light source for emitting a light beam to be deflected by said deflector, said light source being mounted directly on said circuit substrate; and
a photosensitive member for receiving the light beam deflected by said deflector.

50. An image recorder according to claim 49, wherein said circuit substrate is a metal substrate.

51. An image recorder according to claim 50, wherein said metal substrate is an iron substrate.

52. An image recording according to claim 49, wherein said circuit substrate supports a bearing of said deflector.

53. A scanning optical apparatus comprising:
a light source;
a deflector for deflecting a light beam from said light source;
a circuit substrate including drive means for rotating said deflector;
photosensing means for sensing the light beam deflected by said deflector; and
reflecting means provided in an optical path between said deflector and said photosensing means, said reflecting means being mounted directly on said circuit substrate.

54. A scanning optical apparatus according to claim 53, wherein said circuit substrate is a metal substrate.

55. A scanning optical apparatus according to claim 54, wherein said metal substrate is an iron substrate.

56. A scanning optical apparatus according to claim 53, wherein said circuit substrate supports a bearing of said deflector.

57. A scanning optical apparatus according to claim 53, wherein a circuit for said photosensing means is provided on said circuit substrate.

58. A scanning optical apparatus according to claim 53, wherein said photosensing means detects a synchronous signal for determining a start timing for modulation of said light source.

59. A scanning optical apparatus according to claim 53, wherein lens means is further provided in the optical path between said deflector and said photosensing means.

60. A scanning optical apparatus according to claim 59, wherein said lens means is provided on said circuit substrate.

61. An image recorder comprising:
a light source;
a deflector for deflecting a light beam from said light source;
a circuit substrate including drive means for rotating said deflector;
photosensing means for sensing the light beam deflected by said deflector;
reflecting means provided in an optical path between said deflector and said photosensing means, said reflecting means being mounted directly on said circuit substrate; and
a photosensitive member for receiving the light beam deflected by said deflector.

62. An image recorder according to claim 61, wherein said circuit substrate is a metal substrate.

63. An image recorder according to claim 62, wherein said metal substrate is an iron substrate.

64. An image recorder according to claim 61, wherein said circuit substrate supports a bearing of said deflector.

65. An image recorder according to claim 61, wherein a circuit for said photosensing means is provided on said circuit substrate.

66. An image recorder according to claim 61, wherein said photosensing means detects a synchronous signal for determining a start timing for modulation of said light source.

67. An image recorder according to claim 61, wherein lens means is further provided in the optical path between said deflector and said photosensing means.

68. An image recorder according to claim 67, wherein said lens means is provided on said circuit substrate.

69. A scanning optical apparatus comprising:
a light source;
a deflector for deflecting a light beam from said light source;
a circuit substrate including drive means for rotating said deflector; and
reflecting means provided in an optical path between said deflector and photosensing means, said reflecting means being mounted directly on said circuit substrate.

70. A scanning optical apparatus according to claim 69, wherein said circuit substrate is a metal substrate.

71. A scanning optical apparatus according to claim 70, wherein said metal substrate is an iron substrate.

72. A scanning optical apparatus according to claim 69, wherein said circuit substrate supports a bearing of said deflector.

73. An image recorder comprising:

a light source;

a deflector for deflecting a light beam from said light source;

a circuit substrate including drive means for rotating said deflector;

reflecting means provided in an optical path between said deflector and photosensing means, said reflecting means being mounted directly on said circuit substrate; and a photosensitive member for receiving the light beam deflected by said deflector.

74. An image recorder according to claim 73, wherein said circuit substrate is a metal substrate.

75. An image recorder according to claim 74, wherein said metal substrate is an iron substrate.

76. An image recorder according to claim 73, wherein said circuit substrate supports a bearing of said deflector.

77. The scanning optical system of claim 1, wherein said circuit substrate also includes means for mounting said circuit substrate to a sealable housing.

78. The scanning optical system of claim 6, wherein said circuit substrate also includes means for mounting said circuit substrate to a sealable housing.

79. The image recorder of claim 7, wherein said circuit substrate also includes means for mounting said circuit substrate to a sealable housing.

80. The light deflector of claim 8, wherein said circuit substrate also includes means for mounting said circuit substrate to a sealable housing.

81. The scanning optical system of claim 4, wherein said circuit substrate also includes means for mounting said circuit substrate to a sealable housing.

82. The scanning optical system of claim 33, wherein said substrate also includes means for mounting said substrate to a sealable housing.

83. The image recorder of claim 34, wherein said substrate also includes means for mounting said substrate to a sealable housing.

84. The image recorder of claim 44, wherein said substrate also includes means for mounting said substrate to a sealable housing.

85. The scanning optical apparatus of claim 45, wherein said substrate also includes means for mounting said substrate to a sealable housing.

86. The image recorder of claim 49, wherein said circuit substrate also includes means for mounting said circuit substrate to a sealable housing.

87. The scanning optical apparatus of claim 53, wherein said circuit substrate also includes means for mounting said circuit substrate to a sealable housing.

88. The image recorder of claim 61, wherein said circuit substrate also includes means for mounting said circuit substrate to a sealable housing.

89. The scanning optical apparatus of claim 69, wherein said circuit substrate also includes means for mounting said circuit substrate to a sealable housing.

90. The image recorder of claim 73, wherein said circuit substrate also includes means for mounting said circuit substrate to a sealable housing.

* * * * *

UNITED STATES PATENT AND TRADEMARK OFFICE

CERTIFICATE OF CORRECTION

PATENT NO. : 5,394,173

DATED : February 28, 1995

INVENTOR(S) : Takeshi Kubota

It is certified that error appears in the above-identified patent and that said Letters Patent is hereby corrected as shown below:

Column 1, line 32, change "applied-by" to --applied by--.

Column 6, line 50, "optical" should begin a new paragraph.

Column 7, line 33, change "mounted" to --mounted directly--.

Signed and Sealed this

Thirtieth Day of May, 1995

Bruce Lehman

*Attest:*

BRUCE LEHMAN

*Attesting Officer*

*Commissioner of Patents and Trademarks*